US010641292B2

(12) United States Patent
Chen et al.

(10) Patent No.: US 10,641,292 B2
(45) Date of Patent: May 5, 2020

(54) VENTILATING FAN AND FRAME STRUCTURE THEREOF

(71) Applicant: DELTA ELECTRONICS, INC., Taoyuan (TW)

(72) Inventors: Chun-Wei Chen, Taoyuan (TW); Wen-Hsiang Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 350 days.

(21) Appl. No.: 15/705,995

(22) Filed: Sep. 15, 2017

(65) Prior Publication Data

US 2019/0085867 A1 Mar. 21, 2019

(51) Int. Cl.

| | |
|---|---|
| ***F04D 29/62*** | (2006.01) |
| ***F04D 29/28*** | (2006.01) |
| ***F04D 29/42*** | (2006.01) |
| ***F04D 25/08*** | (2006.01) |
| ***F04D 29/60*** | (2006.01) |

(52) U.S. Cl.

CPC ..... *F04D 29/626* (2013.01); *F04D 25/08* (2013.01); *F04D 29/282* (2013.01); *F04D 29/4226* (2013.01); *F04D 29/601* (2013.01)

(58) Field of Classification Search

CPC ..... F04D 29/626; F04D 25/08; F04D 29/282; F04D 29/4226; F04D 29/601; F24F 7/06

USPC ..... 415/213.1

See application file for complete search history.

(56) References Cited

U.S. PATENT DOCUMENTS

| | | | | |
|---|---|---|---|---|
| 2,452,950 | A * | 11/1948 | Morrison | F04D 29/646 454/210 |
| 2,580,663 | A * | 1/1952 | Delf | F24F 7/013 454/210 |
| 2,617,348 | A * | 11/1952 | Sutton | F24F 7/013 454/209 |
| 3,587,441 | A * | 6/1971 | Woods | E06B 9/0638 454/203 |
| 4,011,687 | A * | 3/1977 | Disharoon | E06B 7/03 49/70 |
| 4,838,151 | A * | 6/1989 | Shin-Chin | F04D 25/12 454/200 |
| 5,190,496 | A * | 3/1993 | Shih-Chin | F24F 7/013 454/210 |
| 5,382,136 | A * | 1/1995 | Wang | F04D 25/12 416/247 R |

* cited by examiner

*Primary Examiner* — Aaron R Eastman

(74) *Attorney, Agent, or Firm* — Muncy, Geissler, Olds & Lowe, P.C.

(57) ABSTRACT

A ventilating fan includes a driving device, a rotating blade assembly, and a frame structure. The driving device drives the rotating blade assembly to rotate. The rotating blade assembly includes a hub and at least one blade group arranged on the periphery of the hub. The driving device and the rotating blade assembly are disposed in the frame structure. The frame structure includes a main body and a first mounting plate. The main body is formed by a plurality of side portions, and each side portion has at least one bending part for connecting to the adjacent side portion. At least one of the side portions has a first slot, which is disposed adjacent to the corresponding bend part. The first mounting plate is disposed corresponding to the first slot and located in the main body, and the first mounting plate has at least one fixing portion.

19 Claims, 12 Drawing Sheets

VENTILATING FAN AND FRAME STRUCTURE THEREOF

BACKGROUND OF THE DISCLOSURE

Field of Disclosure

The present disclosure relates to a ventilating fan and, in particular, to a ventilating fan having a movable mounting plate.

Related Art

The ventilating fan is mainly configured for enhancing the indoor air convention so as to maintain the fresh air.

The conventional ventilating fan is fixed to the beams at the ceiling by additional fastening elements such as outer flanges or fixing plates of fan frame. However, the outer flanges or fixing plates of fan frame may not fit the original installation holes on the ceiling. Accordingly, it is necessary to modify or destroy the original installation holes on the ceiling for fixing the ventilating fan to the beams at the ceiling. Therefore, it is desired to optimize the installation of the ventilating fan without modifying or destroying the original installation holes of the ceiling.

SUMMARY OF THE DISCLOSURE

The present disclosure provides a ventilating fan to be mounted on an external structure. The ventilating fan includes a driving device, a rotating blade assembly, and a frame structure. The driving device drives the rotating blade assembly to rotate. The rotating blade assembly includes a hub and at least a blade group, and the blade group is arranged on a periphery of the hub. The frame structure is configured for mounting on the external structure. The driving device and the rotating blade assembly are disposed in the frame structure. The frame structure includes a main body and a first mounting plate. The main body is formed by a plurality of side portions. One side portion has at least a bending part for connecting to the adjacent side portion. At least one of the side portions has a first slot, and the first slot is disposed adjacent to the corresponding bending part. The first mounting plate is disposed corresponding to the first slot and located in the main body. The first mounting plate has at least a fixing portion. The first mounting plate is movable to be received in the main body or to be moved through the first slot to expose from the main body by rotating or sliding.

In one embodiment, the side portions includes a first side portion and a second side portion, which are disposed adjacent to each other. The first side portion has the bending part located at one end of the first side portion, which is disposed adjacent to and connecting to one end of the second side portion. The first slot is configured on the first side portion and located adjacent to the bending part.

In one embodiment, the side portions includes a third side portion disposed at one end of the second side portion and opposite to the first side portion. The third side portion has a bending part located at one end of the third side portion, which is disposed adjacent to and connecting to the opposite end of the second side portion. The third side portion has a second slot located adjacent to the bending part of the third side portion, and the second slot is disposed opposite to the first slot.

In one embodiment, the ventilating fan further includes a second mounting plate disposed corresponding to the second slot and located in the main body. The second mounting plate has at least a fixing portion. The second mounting plate is movable to be received in the main body or to be moved through the second slot to expose from the main body by rotating or sliding.

In one embodiment, one end of the second mounting plate is pivotally connected to an inner wall of the second side portion to form a second pivoting part, the second mounting plate is rotatable about the second pivoting part, and the second mounting plate is capable of passing through the second slot by rotating.

In one embodiment, two sliding assemblies are disposed on an inner wall of the second side portion. The first and second mounting plates are connected to and limited to the sliding assemblies, and the first and second mounting plates are capable of passing through the first and second slots, respectively, by sliding.

In one embodiment, one end of the first mounting plate is pivotally connected to an inner wall of the second side portion to form a first pivoting part. The first mounting plate is rotatable about the first pivoting part, and the first mounting plate is capable of passing through the first slot by rotating.

In one embodiment, a sliding assembly is disposed on an inner wall of the second side portion, and the first mounting plate is connected to and limited to the sliding assembly. The first mounting plate is capable of passing through the first slot by sliding.

In one embodiment, the fixing portions of the first and second mounting plates are hole structures, and the fixing portions of the first and second mounting plates are fixed by nailing, screwing, or riveting, respectively, so as to install the frame structure on the external structure.

In one embodiment, the inner wall of the second side portion has at least a first connecting structure, and each of the first and second mounting plates is configured with at least a second connecting structure. The second connecting structures are disposed corresponding to the first connecting structures, and the first and second mounting plates are fixed to the first connecting structures of the main body via the two second connecting structures, respectively.

In one embodiment, each of the first and second connecting structures is a convex structure, a concave structure, or an opening structure.

In one embodiment, the frame structure further includes at least an elastic plate having a first end and a second end. The first end is connected to the inner wall of the second side portion, and the second end is contacted against and fixed to the first or second mounting plate.

In one embodiment, the first and/or second mounting plates have a plurality of positioning parts corresponding to the second end of the elastic plate, and the second end of the elastic plate is fixed to the corresponding positioning part.

In one embodiment, the elastic plate has at least a bended tail, and the second end of the elastic plate is released from the positioning part by pressing the bended tail.

The present disclosure further provides a ventilating fan, which includes a driving device, a rotating blade assembly, and a frame structure. The driving device drives the rotating blade assembly to rotate. The rotating blade assembly includes a hub and at least a blade group, and the blade group is arranged on a periphery of the hub. The driving device and the rotating blade assembly are disposed in the frame structure. The frame structure includes a main body and a first mounting plate. The main body is formed by a plurality of side portions, and the first mounting plate is disposed on one of the side portions and has at least a fixing portion. The first mounting plate is movable to be relatively moved with respect to the side portion by rotating or sliding, and the first mounting plate is moved to be totally covered by the side portion or to be partially covered by the side portion.

In one embodiment, the ventilating fan further includes a second mounting plate, and the first and second mounting plates are disposed at two opposite ends of the side portion, respectively. The first and second mounting plates are movable to be relatively moved with respect to the side portion by rotating or sliding.

The present disclosure further provides a frame structure of a ventilating fan. The frame structure includes a main body and a first mounting plate. The main body is formed by a plurality of side portions. Or of the side portions has at least a bending part for connecting to adjacent one of the side portions. At least one of the side portions has a first slot, and the first slot is disposed adjacent to the corresponding bending part. The first mounting plate is disposed corresponding to the first slot and located in the main body, and the first mounting plate has at least a fixing portion. The first mounting plate is movable to be received in the main body or to be moved through the first slot to expose from the main body by rotating or sliding.

In one embodiment, the side portions includes a first and second side portions which are disposed adjacent to each other. The first side portion has the bending part located at one end of the first side portion, which is disposed adjacent to and connecting to one end of the second side portion. The first slot is configured on the first side portion and located adjacent to the bending part.

In one embodiment, the side portions includes a third side portion disposed at one end of the second side portion and opposite to the first side portion. The third side portion has a bending part located at one end of the third side portion, which is disposed adjacent to and connecting to the opposite end of the second side portion. The third side portion has a second slot located adjacent to the bending part of the third side portion, and the second slot is disposed opposite to the first slot.

In one embodiment, the frame structure further includes a second mounting plate disposed corresponding to the second slot and located in the main body. The second mounting plate has at least a fixing portion. The second mounting plate is movable to be received in the main body or to be moved through the second slot to expose from the main body by rotating or sliding.

In one embodiment, one end of the second mounting plate is pivotally connected to an inner wall of the second side portion to form a second pivoting part, and the second mounting plate is rotatable about the second pivoting part. Thus, the second mounting plate is capable of passing through the second slot by rotating.

In one embodiment, two sliding assemblies are disposed on an inner wall of the second side portion. The first and second mounting plates are connected to and limited to the sliding assemblies. The first and second mounting plates are capable of passing through the first and second slots, respectively, by sliding.

In one embodiment, one end of the first mounting plate is pivotally connected to an inner wall of the second side portion to form a first pivoting part. The first mounting plate is rotatable about the first pivoting part, and the first mounting plate is capable of passing through the first slot by rotating.

In one embodiment, a sliding assembly is disposed on an inner wall of the second side portion, and the first mounting plate is connected to and limited to the sliding assembly. Thus, the first mounting plate is capable of passing through the first slot by sliding.

In one embodiment, each of the first and second mounting plates has at least a fixing portion, which is a hole structure, and the fixing portions of the first and second mounting plates are fixed by nailing, screwing, or riveting, respectively, so as to install the frame structure on the external structure.

In one embodiment, the inner wall of the second side portion has at least a first connecting structure, and each of the first and second mounting plates is configured with at least a second connecting structure. The second connecting structures are disposed corresponding to the first connecting structures, and the first and second mounting plates are fixed to the first connecting structures of the main body via the second connecting structures, respectively.

In one embodiment, each of the first and second connecting structures is a convex structure, a concave structure, or an opening structure.

In one embodiment, the frame structure further includes at least an elastic plate having a first and second ends. The first end is connected to the inner wall of the second side portion, and the second end is contacted against and fixed to the first or second mounting plate.

In one embodiment, the first mounting plate and/or the second mounting plate have a plurality of positioning parts corresponding to the second end of the elastic plate, and the second end of the elastic plate is fixed to the corresponding positioning part.

In one embodiment, the elastic plate has at least a bended tail, and the second end of the elastic plate is released from the positioning part by pressing the bended tail.

As mentioned above, the ventilating fan of the disclosure has the movable mounting plate(s) for fixing the ventilating fan to the external structure. The mounting plates can be received in the main body or be moved through the slots to (partially) expose from the main body by rotating or sliding. According to this design, the mounting plates can be received in the main body during the installation of the ventilating fan, so that the installation can be performed in the house and suitable for most installation environments. After the ventilating fan is placed at the proper position, the mounting plates are moved to expose from the main body for fastening the entire structure of the ventilating fan. Thus, it is unnecessary to separate and assemble the fan body and fan frame structure in the installation of the ventilating fan, and the installation steps can be simplified. In addition, the design of the elastic plates and protrusions can help to precisely position the mounting plates for facilitating the installation procedure and balancing two sides of the frame structure.

Since the mounting plates are movable, the installation of the ventilating fan can have less spatial limitations. Thus, the installation or uninstallation procedure can be easily performed, and the steps for installing or uninstalling the ventilating fan can be reduced. Besides, the ventilating fan of this disclosure can be fit to most installation environments, and the installation flexibility of the ventilating fan can be increased.

BRIEF DESCRIPTION OF THE DRAWINGS

The present disclosure will become more fully understood from the subsequent detailed description and accompanying drawings, which are given by way of illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

Figure 1A:
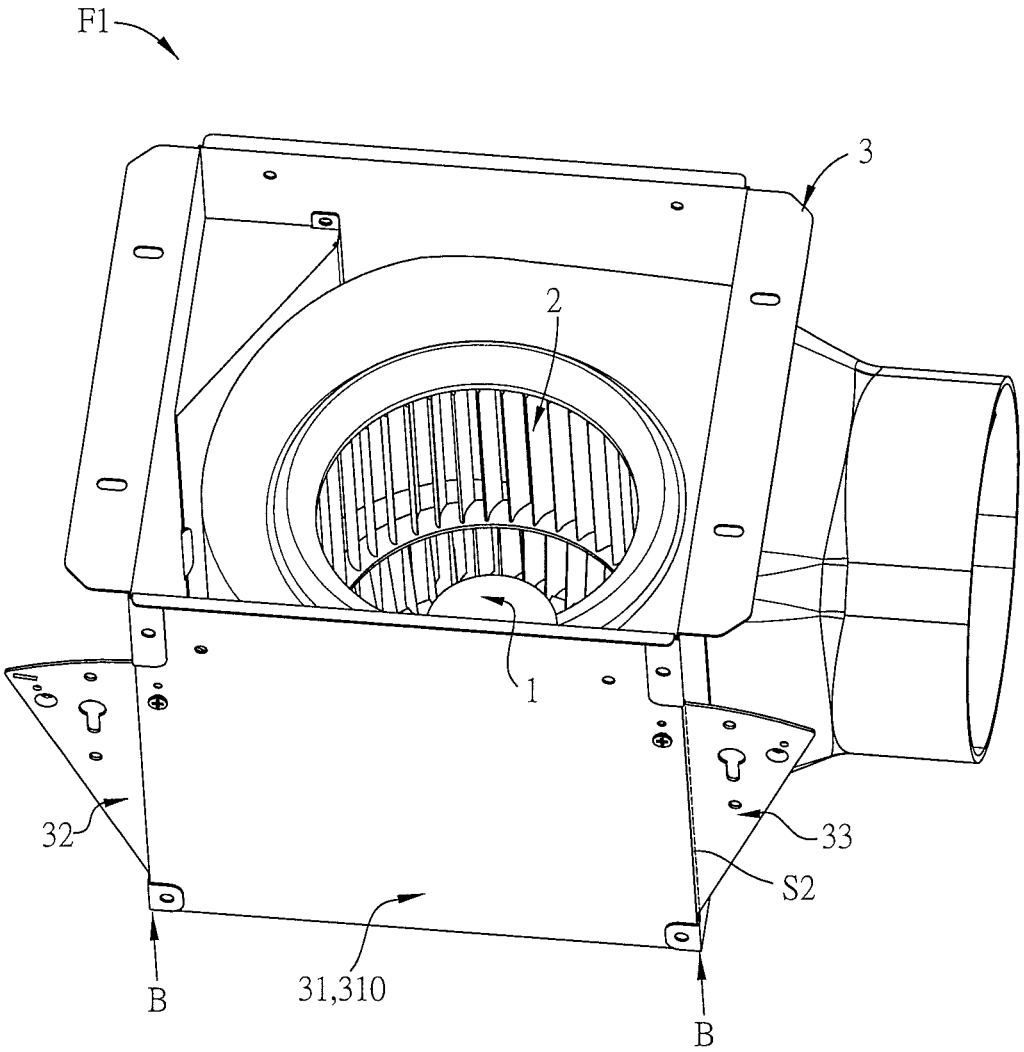
FIG. 1A is a perspective diagram of a ventilating fan according to an embodiment of the disclosure.
Figure 1B:
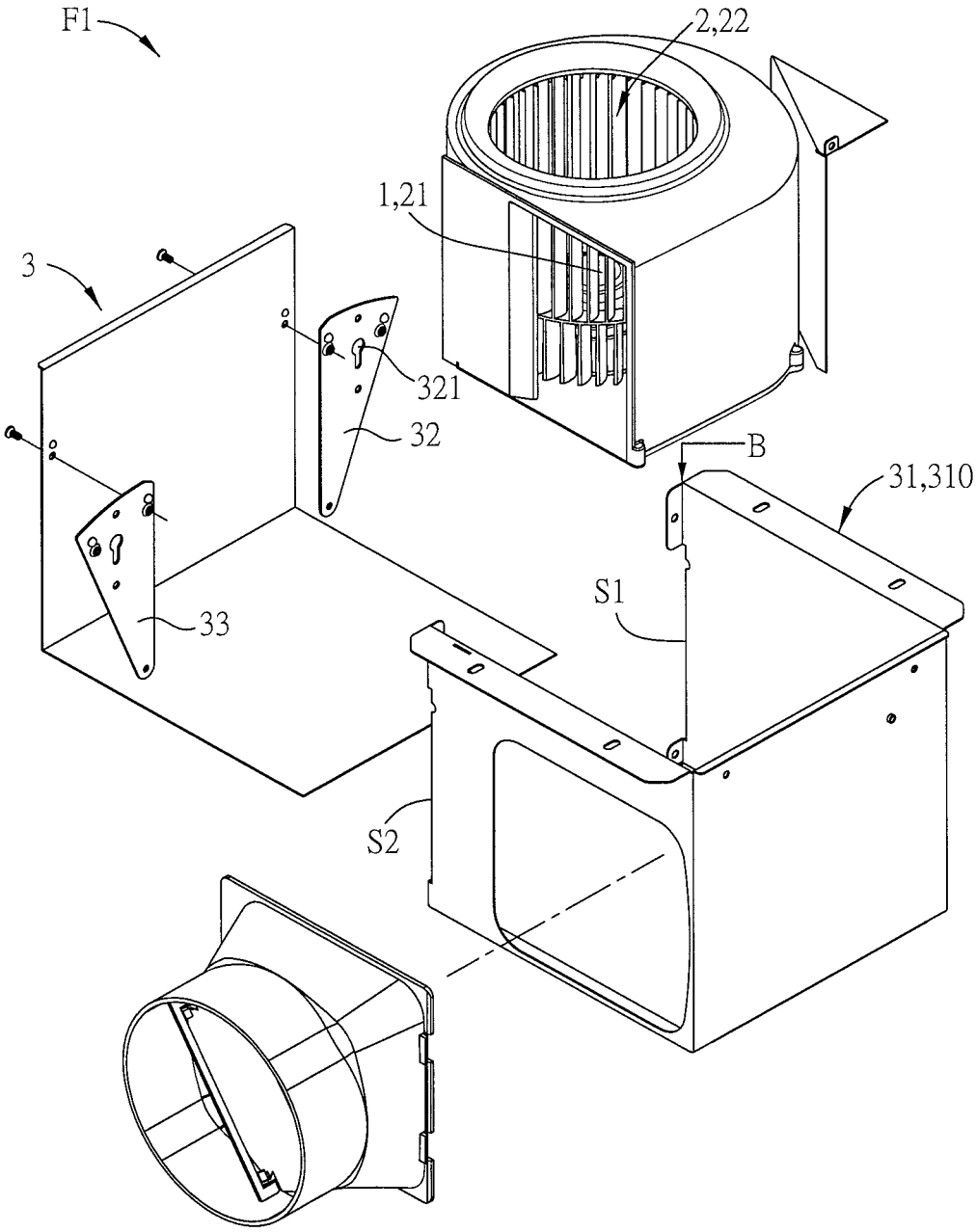
FIG. 1B is an exploded view of the ventilating fan according to the embodiment of the disclosure.
Figure 1C:
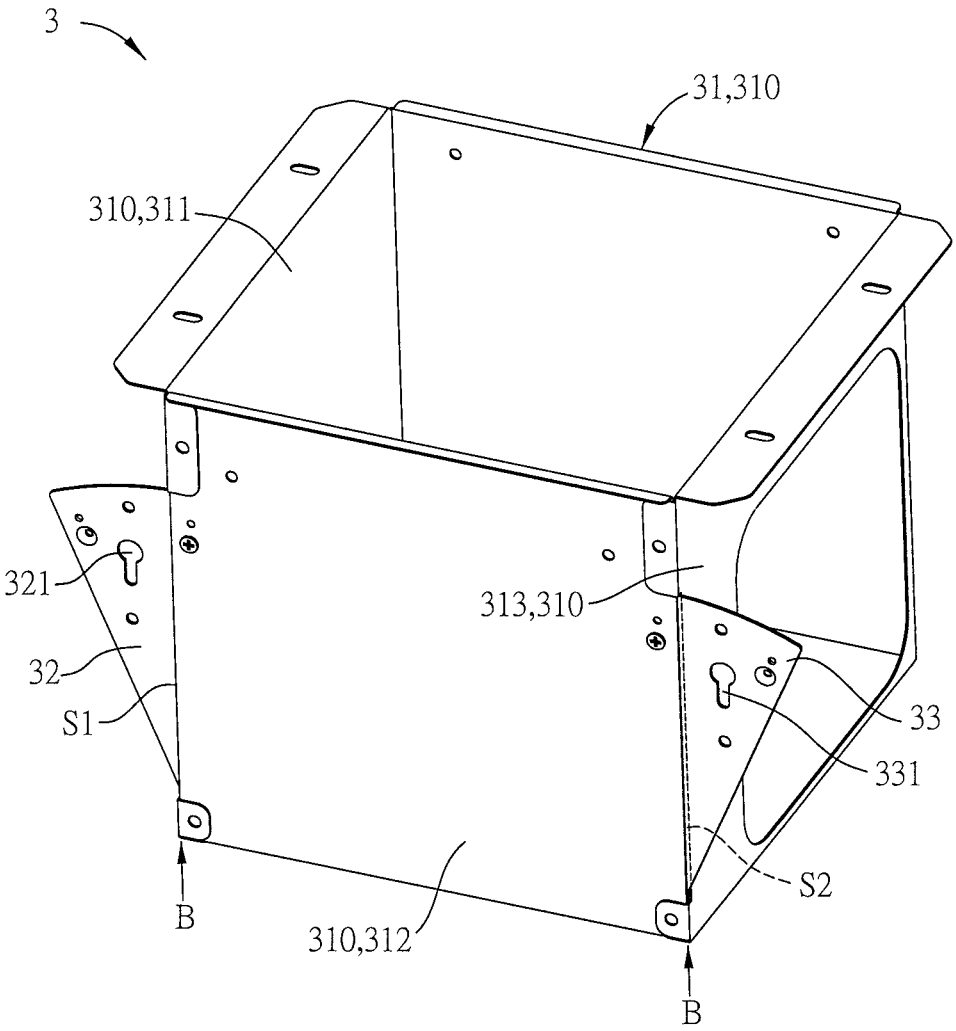
FIG. 1C is a perspective diagram of a frame structure of FIG. 1A.

FIG. 1A is a perspective diagram of a ventilating fan according to an embodiment of the disclosure, FIG. 1B is an exploded view of the ventilating fan according to the embodiment of the disclosure, and FIG. 1C is a perspective diagram of a frame structure of FIG. 1A.

A ventilating fan F1 of the disclosure is configured to be mounted on an external structure. The ventilating fan F1 includes a driving device 1, a rotating blade assembly 2, and a frame structure 3. The driving device 1 drives the rotating blade assembly 2 to rotate. The rotating blade assembly 2 includes a hub 21 and at least a blade group 22. The blade group 22 is arranged on a periphery of the hub 21. The frame structure 3 is configured for mounting on the external structure. The driving device 1 and the rotating blade assembly 2 are disposed in the frame structure 3. The frame structure 3 includes a main body 31 and a first mounting plate 32. The main body 31 is formed by a plurality of side portions 310. One side portion 310 has at least a bending part B for connecting to the adjacent side portion 310. At least one of the side portions 310 has a first slot S1, which is disposed adjacent to the corresponding bending part B. The first mounting plate 32 is disposed corresponding to the first slot S1 and located in the main body 31. The first mounting plate 32 has at least a fixing portion 321. The first mounting plate 32 is movable to be received in the main body 31 and to be moved through the first slot S1 to expose from the main body 31 by rotating or sliding.

The ventilating fan of this disclosure can be mounted on the external structure by the movable mounting plate. The mounting plate can be received in the main body or be moved through the slot to expose from the main body by rotating or sliding. In addition, the frame structure may include two mounting plates for installing at different environments.

Referring to FIGS. 1A to 1C, 2A and 2B, the side portions 310 includes a first and second side portions 311, 312 which are disposed adjacent to each other. The first side portion 311 has the bending part B located at one end of the first side portion 311, which is disposed adjacent to and connecting to one end of the second side portion 312. The first slot S1 is configured at one side of the first side portion 311 and located adjacent to the bending part B. After assembling the first and second side portions 311, 312, the first mounting plate 32 can be exposed from the main body 31 or received in the main body 31 through the first slot S1. In addition, the first slot S1 can be disposed on the first side portion 311 and located adjacent to the bending part B.

Similarly, the side portions 310 includes a third side portion 313 disposed at one end of the second side portion 312 and opposite to the first side portion 311. The third side portion 313 has a bending part B located at one end of the third side portion 313, which is disposed adjacent to and connecting to the opposite end of the second side portion 312. The third side portion 313 has a second slot S2 configured at one side of the third side portion 313 and located adjacent to the bending part B of the third side portion 313, and the second slot S2 is disposed opposite to the first slot S1. The frame structure 3 further includes a second mounting plate 33 disposed corresponding to the second slot S2 and located in the main body 31. The second mounting plate 33 has at least a fixing portion 331. The second mounting plate 33 is movable to be received in the main body 31 or to be moved through the second slot S2 to expose from the main body 31 by rotating or sliding. The second slot S2 is configured at one side of the third side portion 313. After assembling the third side portion 313 and the second side portion 312, the second mounting plate 33 can be exposed from the main body 31 or received in the main body 31 through the second slot S2.

In addition, the fixing portions 321 and 331 of the first and second mounting plates 32, 33 are hole structures. The first and second mounting plates 32, 33 can be fixed by nailing, screwing, or riveting through the fixing portions 321 and 331 so as to install the frame structure 3 on the external structure.

In order to precisely position the mounting plates, the inner wall of the second side portion 312 of the main body 31 is configured with at least one first connecting structure 3121, and the first and second mounting plates 32, 33 are at least configured with the second connecting structures 323 and 333, respectively. The second connecting structures 323 and 333 are disposed corresponding to the first connecting structures 3121, respectively, and the first and second mounting plates 32, 33 are fixed to the first connecting structures 3121 of the main body 31 via the second connecting structures 323 and 333, respectively. In this embodiment, each of the first connecting structures 3121 and the second connecting structures 323 and 333 is a convex structure, a concave structure (not shown), or an opening structure (not shown).

In more detailed, the second connecting structures 323 and 333 are disposed corresponding to the first connecting structures 3121, respectively. When the first mounting plate 32 or the second mounting plate 33 is received in the main body 31 or exposed from the main body 31, the first and second mounting plates 32, 33 are fixed to the first connecting structures 3121 of the main body 31 via the second connecting structures 323 and 333, respectively. The first connecting structure 3121 is connected to the corresponding one of the second connecting structures 323 and 333, and the corresponding connecting structures can be a convex structure and a convex structure, a convex structure and a concave structure, a concave structure and a concave structure, or a convex structure and an opening structure.

In the following aspects, the frame structure of the ventilating fan has two mounting plates cooperating with the second side portion. To make the drawings much clear, only the second side portion, the first and second mounting plates are shown and the other components of the frame structure are omitted.

Referring to FIGS. 1A to 1C, 2A and 2B, the first and second mounting plates 32, 33 can be received in the main body 31 or exposed from the main body 31 by rotating, and the connecting structure is a convex structure. In this embodiment, one end of the first mounting plate 32 is pivotally connected to an inner wall of the second side portion 312 to form a first pivoting part 322, and the first mounting plate 32 is rotatable about the first pivoting part 322, so that the first mounting plate 32 can partially pass through the first slot S1 by rotating and expose from the main body 31. Similarly, one end of the second mounting plate 33 is pivotally connected to the inner wall of the second side portion 312 to form a second pivoting part 332, and the second mounting plate 33 is rotatable about the second pivoting part 332, so that the second mounting plate 33 can partially pass through the second slot S2 by rotating and expose from the main body 31. In addition, a part of the second mounting plate 33 is fixed on the inner wall of the of the second side portion 312 of the main body 31.

Figure 2A:
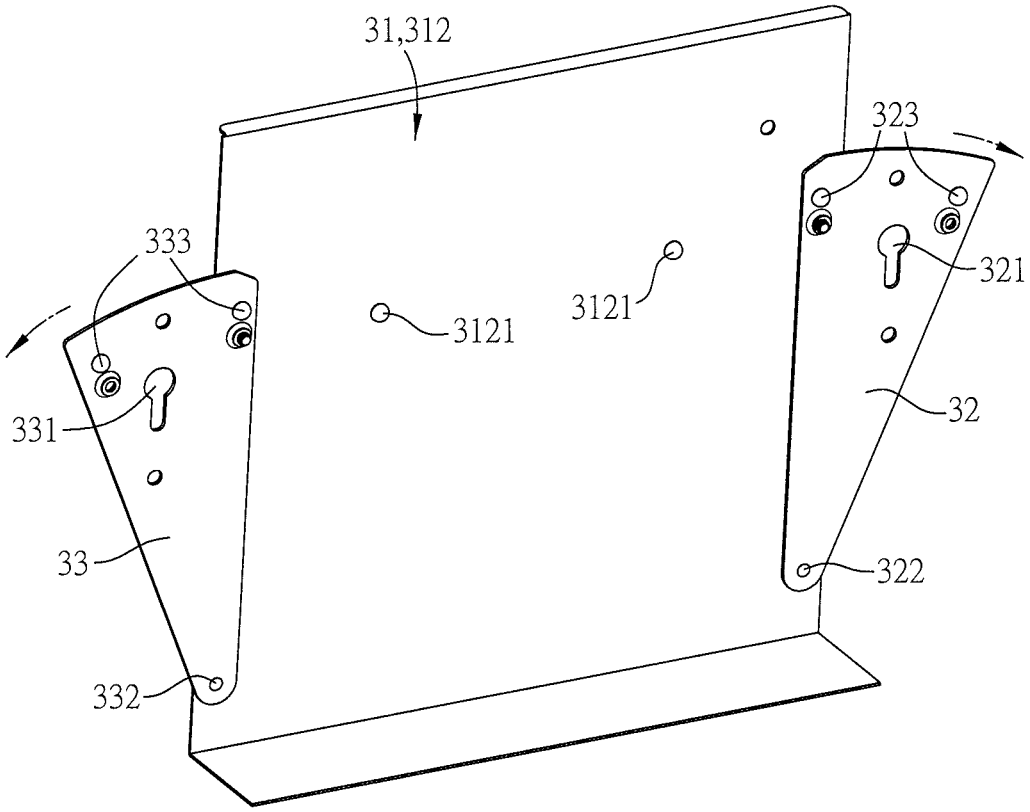
FIGS. 2A, 2B, 3A, 3B, 4A, 4B, 5A, and 5B are schematic diagrams showing the first mounting plate, the second mounting plate and the second side portion of different aspects.
Figure 2B:
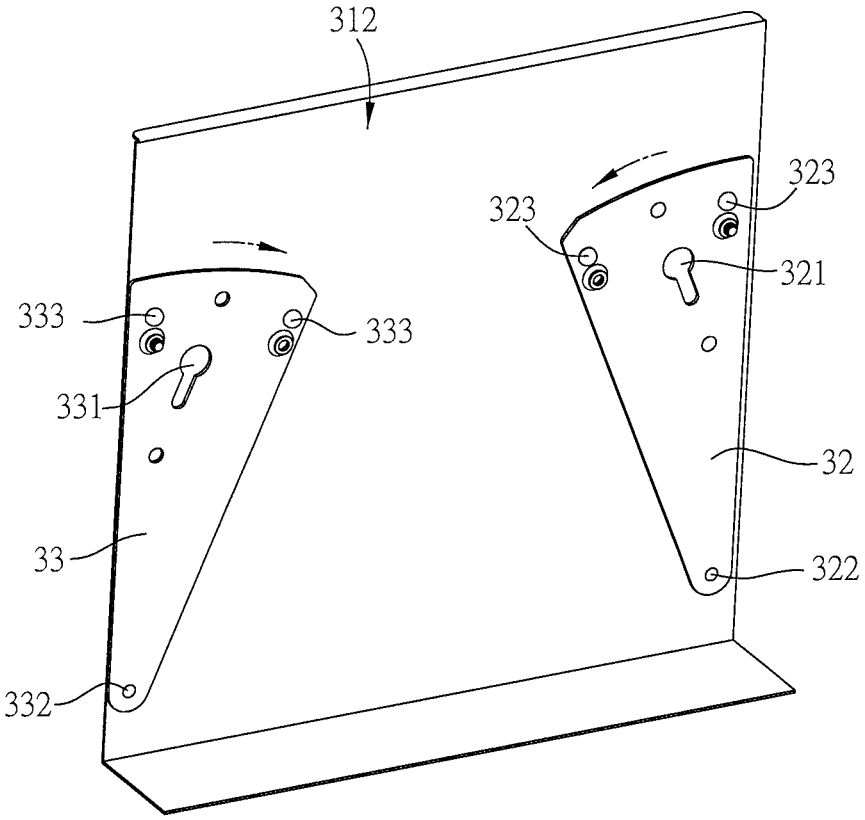

As shown in FIG. 2A, the first and second mounting plates 32, 33 can rotate about the first and second pivoting parts 322, 332, respectively, and they can partially pass through the first slot S1 and the second slot S2, respectively, to expose from the main body 31. As shown in FIG. 2B, the first and second mounting plates 32, 33 can rotate about the first and second pivoting parts 322, 332, respectively, and they can pass through the first and second slots S1, S2, respectively, to be received in the main body 31. Besides, in order to precisely position the first and second mounting plates 32, 33, the inner wall of the second side portion 312 of the main body 31 is configured with at least one first connecting structure 3121, which is a convex structure, and the first and second mounting plates 32, 33 have second connecting structures 323 and 333, respectively, which are also convex structures. To be noted, the convex structure can be, for example but not limited to, a protrusion. Besides, the first connecting structure 3121 and the second connecting structures 323 and 333 can be screws (e.g. a half-thread screw). In this case, the screw can be still restricted on the second side portion 312 while releasing the screw. This configuration can prevent the loss of the screw.

Figure 3A:
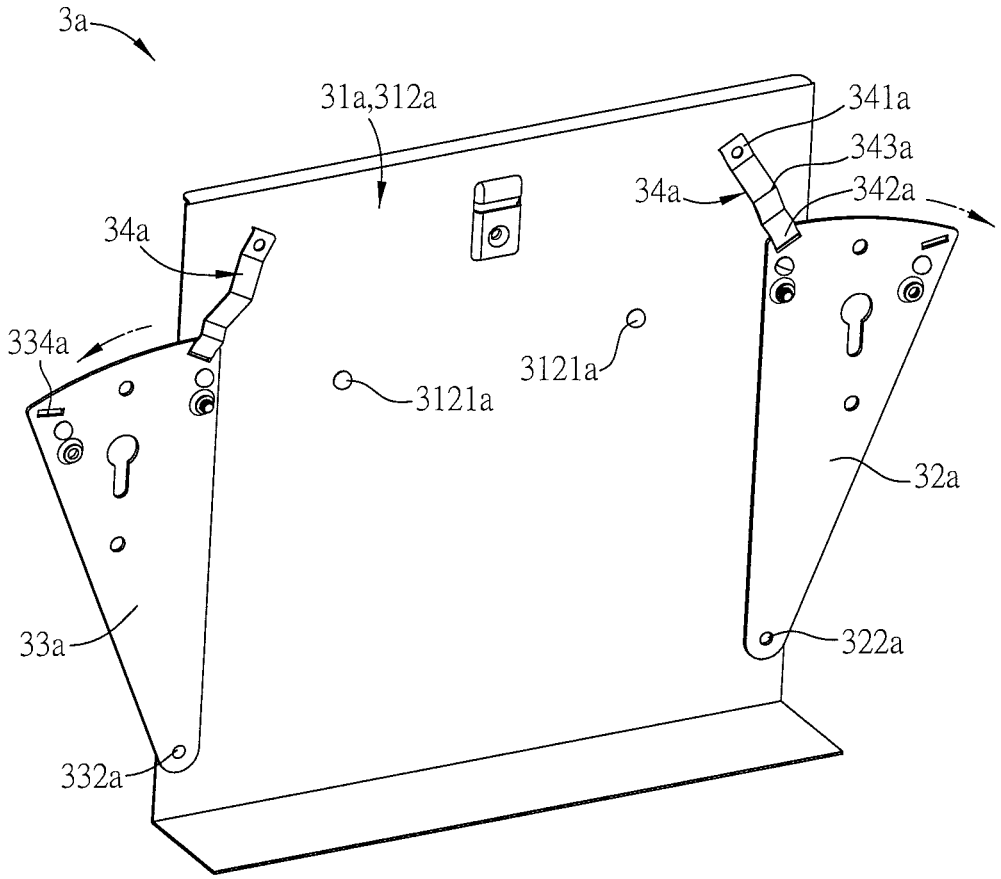
Figure 3B:
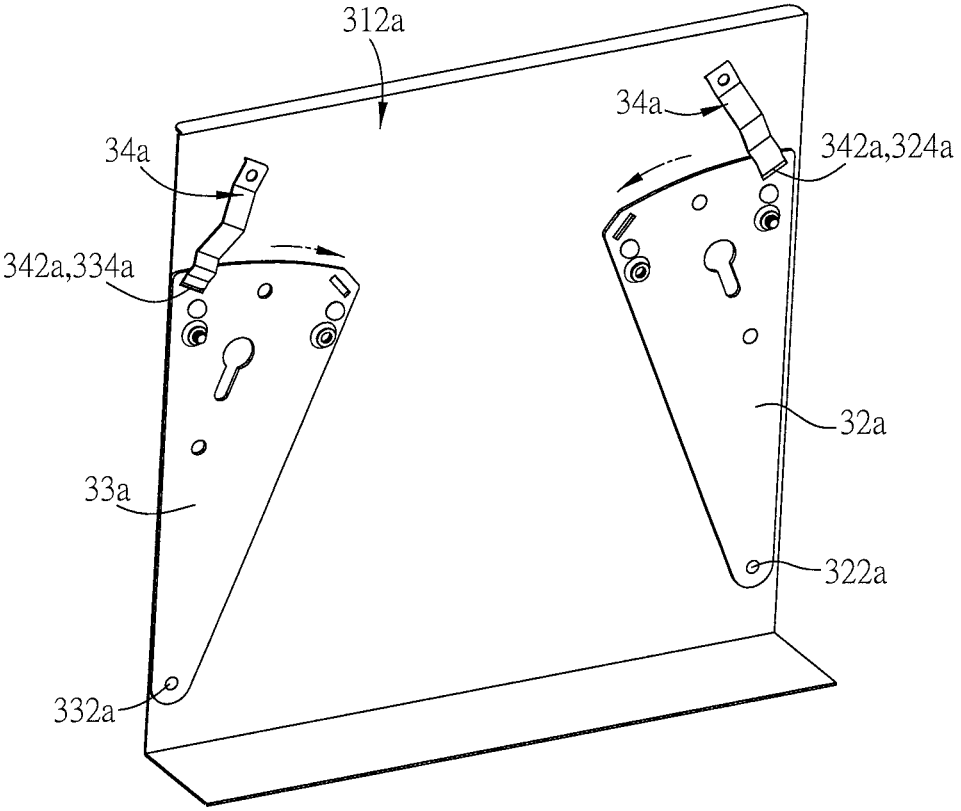

Referring to FIGS. 1A to 1C, 3A and 3B, the first and second mounting plates 32*a*, 33*a* can be received in the main body 31*a* or exposed from the main body 31*a* by rotating, and the connecting structure is an elastic plate and/or a convex structure. In this embodiment, as shown in FIG. 3A, the first and second mounting plates 32*a*, 33*a* are rotatable about the first and second pivoting parts 322*a*, 332*a*, respectively, so that the first and second mounting plates 32*a*, 33*a* can partially expose from the main body 31*a* by rotating. As shown in FIG. 3B, the first and second mounting plates 32*a*, 33*a* are rotatable about the first and second pivoting parts 322*a*, 332*a*, respectively, so that the first and second mounting plates 32*a*, 33*a* can be received in the main body 31*a* by rotating.

Besides, in order to precisely position the first and second mounting plates 32*a*, 33*a*, the frame structure 3*a* further includes at least an elastic plate 34*a* having a first and second ends 341*a*, 342*a*. The first end 341*a* is connected to the inner wall of the second side portion 312*a*, and the second end 342*a* is contacted against and fixed to the first mounting plate 32*a* or the second mounting plate 33*a*. In addition, the first and/or second mounting plate 32*a*, 33*a* have a plurality of positioning parts 324*a*, 334*a* corresponding to the second end 342*a* of the elastic plate 34*a*, which is fixed to the corresponding positioning part 324*a*, 334*a*. In this embodiment, the positioning part 324*a*, 334*a* can be a trench, an opening, or a hook.

When the first mounting plate 32*a* or the second mounting plate 33*a* is received in the main body 31*a*, the second end 342*a* is fixed to the positioning part 324*a*, 334*a*. When the first mounting plate 32*a* or the second mounting plate 33*a* is exposed from the main body 31*a*, the second end 342*a* of the elastic plate 34*a* is fixed to another positioning part 324*a*, 334*a*. Herein, the elastic plate 34*a* has at least a bended tail 343*a*, and the second end 342*a* of the elastic plate 34*a* is released from the positioning part 324*a*, 334*a* by pressing the bended tail 343*a*. Thus, the first mounting plate 32*a* or the second mounting plate 33*a* can be rotated until the second end 342*a* of the elastic plate 34*a* is fixed to another positioning part 324*a*, 334*a*. Besides, the first and second mounting plates 32*a*, 33*a* can be further configured with a first connecting structure 3121*a* and second connecting structures 323*a* and 333*a*, respectively. This configuration can further improve the stability of the first and/or second mounting plates 32*a*, 33*a*.

Referring to FIGS. 1A to 1C, 4A and 4B, the first and second mounting plates 32*b*, 33*b* can be received in the main body 31*b* or exposed from the main body 31*b* by sliding, and the connecting structure is a convex structure. In this embodiment, the inner wall of the second side portion 312*b* is configured with two sliding assemblies 3122*b* and 3123*b*. The first and second mounting plates 32*b*, 33*b* are limited to the sliding assemblies 3122*b* and 3123*b*, so that the first and second mounting plate 32*b*, 33*b* can partially pass through the first and second slots S1, S2, respectively, to expose from the main body 31*b* by sliding. The sliding assemblies 3122*b* and 3123*b* are disposed on the second side portion 312*b* and are located corresponding to the top sides and bottom sides of the first and second mounting plates 32*b*, 33*b*, respectively, for limiting the top portions and bottom portions of the first and second mounting plates 32*b*, 33*b*. In addition, if the frame structure 3*b* includes only one mounting plate (not shown), the inner wall of the second side portion may be configured with one sliding assembly. The first mounting plate is limited to the sliding assembly for partially passing through the first slot to expose from the main body.

Figure 4A:
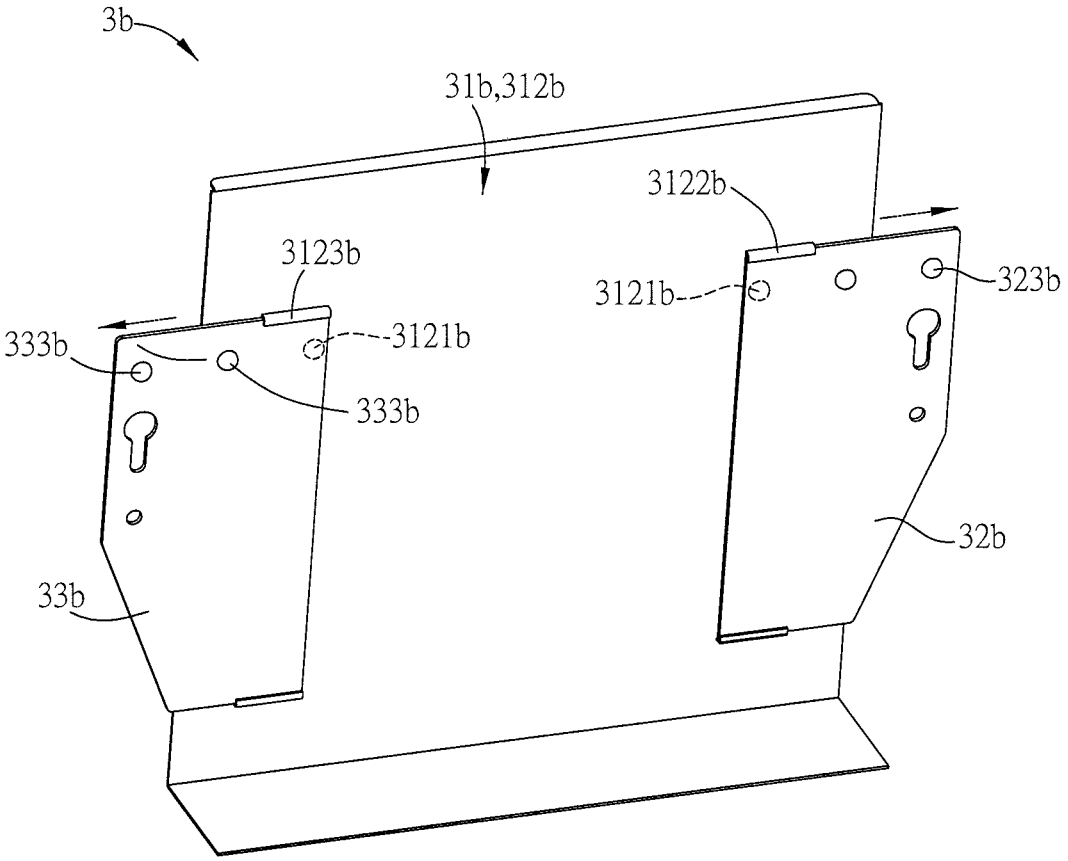
Figure 4B:
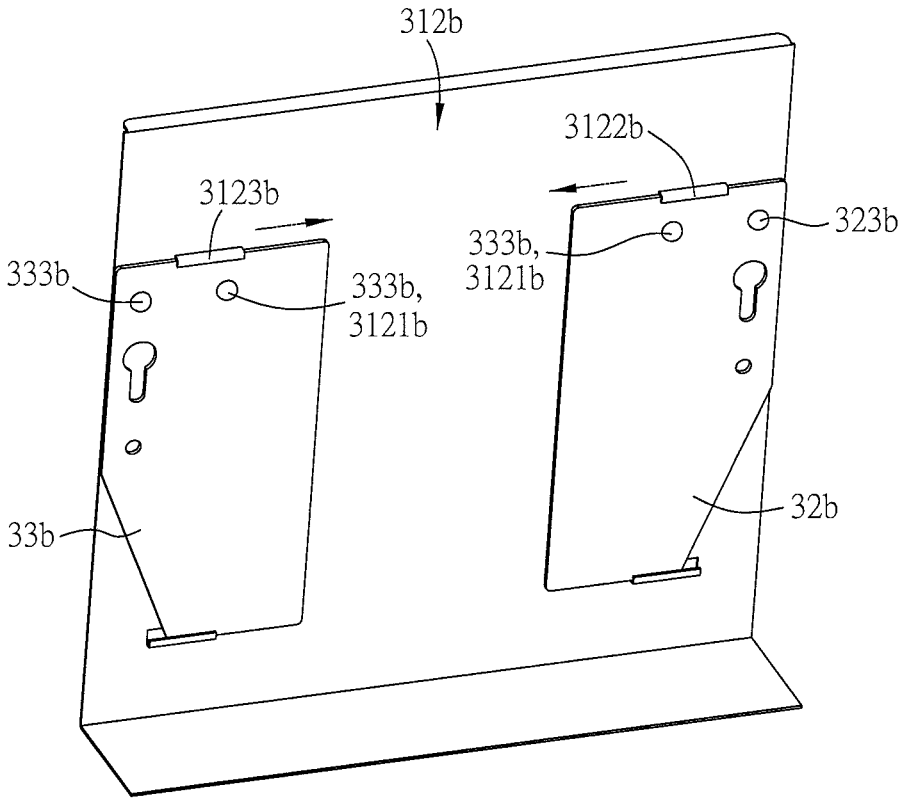

As shown in FIG. 4A, the first and second mounting plates 32*b*, 33*b* can slide along the sliding assemblies 3122*b* and 3123*b*, respectively, so as to partially expose from the main body 31*b* by sliding. As shown in FIG. 4B, the first and second mounting plates 32*b*, 33*b* can slide along the sliding assemblies 3122*b* and 3123*b*, respectively, so as to be received in the main body 31*b* by sliding. Besides, in order to precisely position the first and second mounting plates 32*b*, 33*b*, the inner wall of the second side portion 312*b* of the main body 31*b* is configured with at least one first connecting structure 3121*b*, which is a convex structure, and the first and second mounting plates 32*b*, 33*b* have second connecting structures 323*b* and 333*b*, respectively, which are also convex structures. To be noted, the convex structure can be, for example but not limited to, a protrusion. Besides, the first connecting structure 3121*b* and the second connecting structures 323*b* and 333*b* can be screws (e.g. a half-thread screw). In this case, the half-thread screw can be still restricted on the second side portion 312*b* while releasing the half-thread screw. This configuration can prevent the loss of the screw.

Figure 5A:
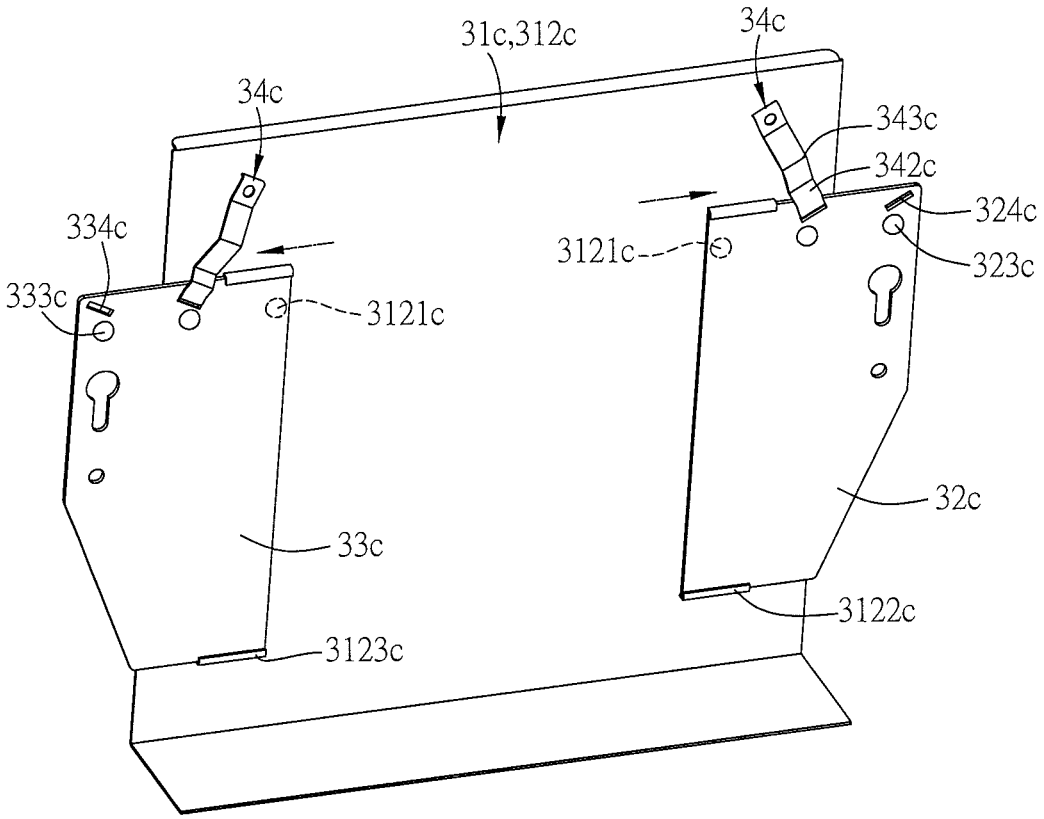
Figure 5B:
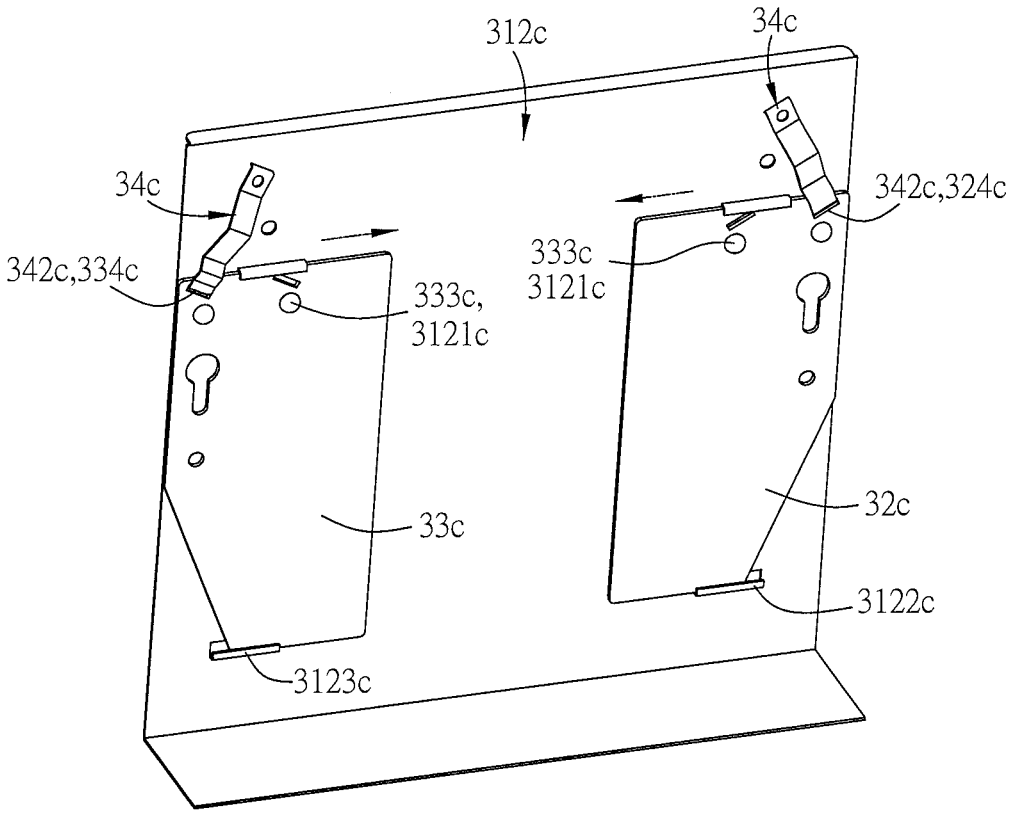

Referring to FIGS. 5A and 5B, the first and second mounting plates 32*c*, 33*c* can be received in the main body 31*c* or exposed from the main body 31*c* by sliding, and the connecting structure is an elastic plate structure and/or a convex structure. As shown in FIG. 5A, the first and second mounting plates 32*c*, 33*c* can slide along the sliding assemblies 3122*c* and 3123*c*, respectively, so as to partially expose from the main body 31*c* by sliding. As shown in FIG. 5B, the first and second mounting plates 32*c*, 33*c* can slide along the sliding assemblies 3122*c* and 3123*c*, respectively, so as to be received in the main body 31*c* by sliding.

Similar to the above embodiment of FIGS. 3A and 3B, in order to precisely position the first and second mounting plates 32*c*, 33*c*, the frame structure 3*c* further includes at least an elastic plate 34*c* for positioning the first and second mounting plates 32*c*, 33*c*. FIG. 5A shows the state that the first and second mounting plates 32*c*, 33*c* are pulled out, and the second end 342*c* of the elastic plate 34*c* is fixed to the positioning parts 324*c*, 334*c* of the first and second mounting plates 32*c*, 33*c*, respectively. The elastic plate 34*c* has at least a bended tail 343*c*, and the second end 342*c* of the elastic plate 34*c* is released from the positioning part 324*c*, 334*c* by pressing the bended tail 343*c*. Thus, the first mounting plate 32*c* or the second mounting plate 33*c* can be rotated until the second end 342*c* of the elastic plate 34*c* is fixed to another positioning part 324*c*, 334*c*, respectively. FIG. 5B shows the state that the first and second mounting plates 32*c*, 33*c* are received in the main body 31*c*, and the second ends 342*c* of the elastic plates 34*c* are fixed to the positioning parts 324*c*, 334C of the first and second mounting plate 32*c*, 33*c*, respectively. Besides, the first mounting plate 32*c* or the second mounting plate 33*c* can be further fastened by a first connecting structure 3121*c* of the second side portion 312*c*, the second connecting structures 323*c* of the first mounting plate 32*c*, and the second connecting structures 333*c* of the second mounting plate 33*c*. This configuration can further improve the stability of the first mounting plate 32*c* or the second mounting plate 33*c*.

Figure 6:
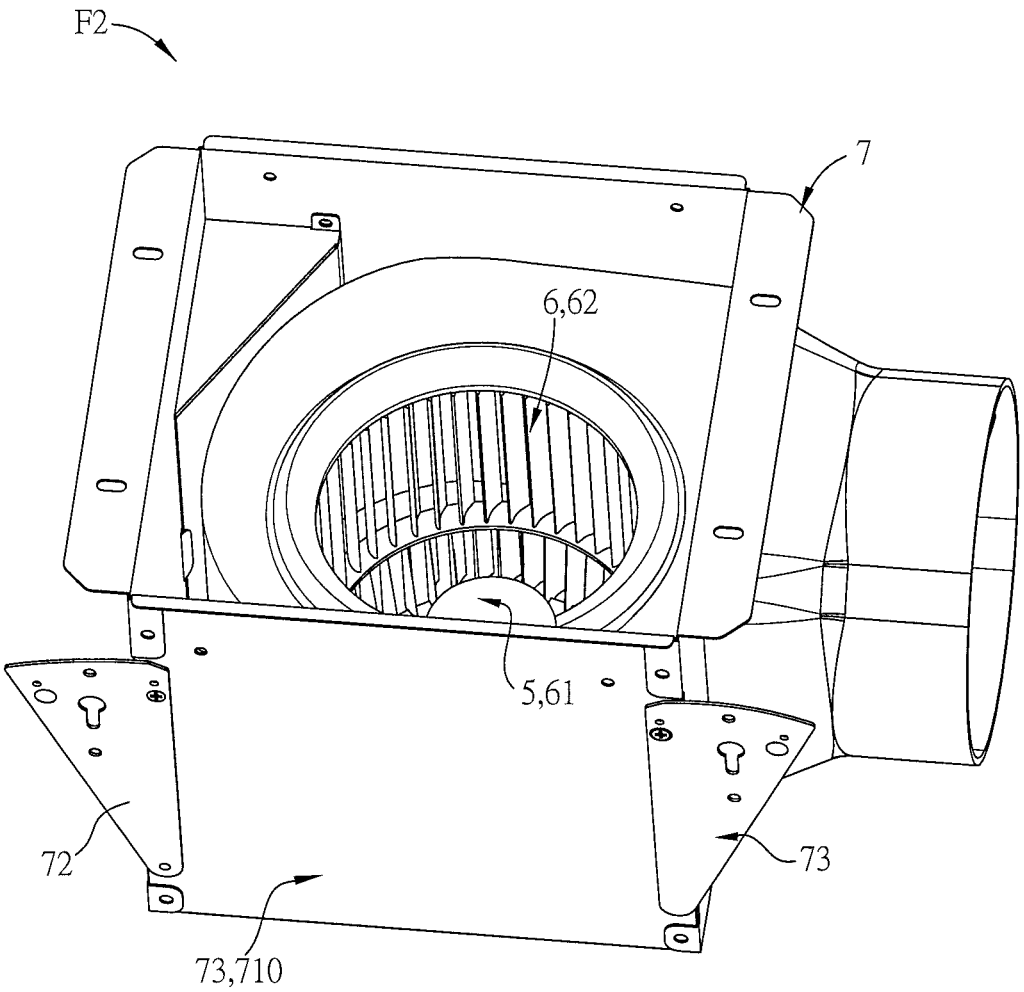
FIG. 6 is a perspective diagram of a ventilating fan according to another embodiment of the disclosure.

FIG. 6 is a perspective diagram of a ventilating fan according to another embodiment of the disclosure. As shown in FIG. 6, the ventilating fan F2 includes a driving device 5, a rotating blade assembly 6, and a frame structure 7. The driving device 5 drives the rotating blade assembly 6 to rotate. The rotating blade assembly 6 includes a hub 61 and at least a blade group 62, and the blade group 62 is arranged on a periphery of the hub 61. The driving device 5 and the rotating blade assembly 6 are disposed in the frame structure 7. The frame structure 7 includes a main body 71 and a first mounting plate 72. The main body 71 is formed by a plurality of side portions 710, and the first mounting plate 72 is disposed on one of the side portions 710 and has at least a fixing portion. The first mounting plate 72 is movable to be relatively moved with respect to the side portion 710 by rotating or sliding, and the first mounting plate 72 is moved to be totally covered by the side portion 710 or to be partially covered by the side portion 710. In more detailed, the first mounting plate 72 can be disposed on the outer wall of the side portion 710 of the main body 71. Besides, the first mounting plate 72 can be totally received within the range of the outer wall of the side portion 710 of the main body 71, so that the entire first mounting plate 72 is located within the projection of the side portion 710. In addition, the first mounting plate 72 can be partially disposed on the side portion 710 and partially exposed from the side portion 710 of the main body 71. Thus, the first mounting plate 72 is partially protruded from the projection of the side portion 710.

In this embodiment, the frame structure 7 further includes a second mounting plate 73, and the first and second mounting plates 72, 73 are disposed at two opposite ends of the side portion 710, respectively. The first and second mounting plates 72, 73 are movable to be relatively moved with respect to the side portion 710 by rotating or sliding.

In the ventilating fan F2 of this embodiment, the first and/or second mounting plates 72, 73 are movably disposed on the outer wall of the side portion 710 of the main body 71, and they can be moved by rotating or sliding to be totally covered or partially covered by the projection of the side portion 710. In addition, the frame structure 7 may include two mounting plates for installing at different environments.

The cooperation, aspects, features and theories of the first and second mounting plates 72, 73 and the side portion 710 can be referred to those disclosed in the previous embodiments with reference to FIGS. 2A, 2B, 3A, 3B, 4A, 4B, 5A, and 5B, so the detailed descriptions thereof will be omitted.

In summary, the ventilating fan and frame structure of the disclosure have the movable mounting plate(s) for fixing the ventilating fan to the external structure. The mounting plates can be received in the main body or be moved through the slots to (partially) expose from the main body by rotating or sliding. According to this design, the mounting plates can be received in the main body during the installation of the ventilating fan, so that the installation can be performed in the house and suitable for most installation environments. After the ventilating fan is placed at the proper position, the mounting plates are moved to expose from the main body for fastening the entire structure of the ventilating fan. Thus, it is unnecessary to separate and assemble the fan body and fan frame structure in the installation of the ventilating fan, and the installation steps can be simplified. In addition, the design of the elastic plates and protrusions can help to precisely position the mounting plates for facilitating the installation procedure and balancing two sides of the frame structure.

Since the mounting plates are movable and foldable, the size of the ventilating fan or the frame structure is smaller and the installation of the ventilating fan can have less spatial limitations. Thus, the installation or uninstallation procedure can be easily performed, and the steps for installing or uninstalling the ventilating fan can be reduced. Besides, the ventilating fan of this disclosure can be fit to most installation environments, and the installation flexibility of the ventilating fan can be increased.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A ventilating fan configured for mounting on an external structure, comprising:

a driving device;

a rotating blade assembly, wherein the driving device drives the rotating blade assembly to rotate, the rotating blade assembly comprises a hub and at least a blade group, and the blade group is arranged on a periphery of the hub; and a frame structure configured for mounting on the external structure, wherein the driving device and the rotating blade assembly are disposed in the frame structure, and the frame structure comprises:

a main body formed by a plurality of side portions, wherein one of the side portions has a bending part for connecting to adjacent one of the side portions, at least one of the side portions has a first slot, the first slot is disposed adjacent to the corresponding bending part, the first slot and the corresponding bending part are at an edge of a lateral view of the frame structure, and a first mounting plate disposed corresponding to the first slot and located in the main body, wherein the first mounting plate has at least a fixing portion;

wherein the first mounting plate is movable to be received in the main body or to be moved through the first slot to expose from the main body by rotating or sliding.

2. The ventilating fan of claim 1, wherein the side portions comprise a first side portion and a second side portion, which are disposed adjacent to each other, the first side portion has the bending part located at one end of the first side portion, which is disposed adjacent to and connecting to one end of the second side portion, and the first slot is configured on the first side portion and located adjacent to the bending part of the first side portion.

3. The ventilating fan of claim 2, wherein the side portions comprise a third side portion disposed at one opposite end of the second side portion and opposite to the first side portion, the third side portion has a bending part located at one end of the third side portion, which is disposed adjacent to and connecting to the opposite end of the second side portion, the third side portion has a second slot located adjacent to the bending part of the third side portion, and the second slot is disposed opposite to the first slot.

4. The ventilating fan of claim 3, further comprising a second mounting plate disposed corresponding to the second slot and located in the main body, wherein the second mounting plate has at least a fixing portion;

wherein the second mounting plate is movable to be received in the main body or to be moved through the second slot to expose from the main body by rotating or sliding.

5. The ventilating fan of claim 4, wherein one end of the first mounting plate is pivotally connected to an inner wall of the second side portion to form a first pivoting part, the first mounting plate is rotatable about the first pivoting part, the first mounting plate is capable of passing through the first slot, one end of the second mounting plate is pivotally connected to the inner wall of the second side portion to form a second pivoting part, the second mounting plate is rotatable about the second pivoting part, and the second mounting plate is capable of passing through the second slot by rotating.

6. The ventilating fan of claim 4, further comprising two sliding tracks disposed on an inner wall of the second side portion, wherein the first mounting plate and the second mounting plate are connected to and limited to the sliding tracks, and the first mounting plate and the second mounting plate are capable of passing through the first slot and the second slot, respectively, by sliding.

7. The ventilating fan of claim 4, wherein the fixing portions of the first mounting plate and the second mounting plate are hole structures, and the fixing portions of the first mounting plate and the second mounting plate are fixed by nailing, screwing, or riveting so as to install the frame structure on the external structure.

8. The ventilating fan of claim 4, wherein an inner wall of the second side portion has first connecting structures, the first mounting plate and the second mounting plate are configured with second connecting structures, the second connecting structures are disposed corresponding to the first connecting structures, and the first mounting plate and the second mounting plate are fixed to the first connecting structures of the main body via the second connecting structures;

wherein one of the first connecting structures and the second connecting structures is a convex structure, a concave structure, or an opening structure.

9. The ventilating fan of claim 4, wherein the frame structure further comprises:

at least an elastic plate having a first end and a second end, wherein the first end is connected to an inner wall of the second side portion, and the second end is contacted against and fixed to the first mounting plate or the second mounting plate;

wherein the first mounting plate or the second mounting plate has a plurality of positioning parts corresponding to the second end of the elastic plate, and the second end of the elastic plate is fixed to the corresponding positioning part; and wherein the elastic plate has at least a bended tail, and the second end of the elastic plate is released from the positioning part by pressing the bended tail.

10. A ventilating fan, comprising:

a driving device;

a rotating blade assembly, wherein the driving device drives the rotating blade assembly to rotate, the rotating blade assembly comprises a hub and at least a blade group, and the blade group is arranged on a periphery of the hub; and a frame structure, wherein the driving device and the rotating blade assembly are disposed in the frame structure, and the frame structure comprises:

a main body formed by a plurality of side portions, and a first mounting plate disposed on one of the side portions and having at least a fixing portion;

wherein the first mounting plate is movable to be relatively moved with respect to the side portion by rotating, and the first mounting plate is moved to be totally covered by the side portion or to be partially covered by the side portion.

11. The ventilating fan of claim 10, further comprising a second mounting plate, wherein the first mounting plate and the second mounting plate are disposed at two opposite ends of the side portion, and the first mounting plate and the second mounting plate are movable to be relatively moved with respect to the side portion by rotating or sliding.

12. A frame structure of a ventilating fan, comprising:

a main body formed by a plurality of side portions, wherein one of the side portions has a bending part for connecting to adjacent one of the side portions, at least one of the side portions has a first slot, and the first slot is disposed adjacent to the corresponding bending part; and a first mounting plate disposed corresponding to the first slot and located in the main body, wherein the first mounting plate has at least a fixing portion;

wherein the first mounting plate is movable to be received in the main body or to be moved through the first slot to expose from the main body by rotating or sliding, and wherein the side portions comprise a first side portion and a second side portion, which are disposed adjacent to each other, the first side portion has the bending part located at one end of the first side portion, which is disposed adjacent to and connecting to one end of the second side portion, and the first slot is configured on the first side portion and located adjacent to the bending part, one end of the first mounting plate is pivotally connected to an inner wall of the second side portion to form a first pivoting part, the first mounting plate is rotatable about the first pivoting part, the first mounting plate is capable of passing through the first slot by rotating.

13. The frame structure of claim 12, wherein the side portions comprise a third side portion disposed at one opposite end of the second side portion and opposite to the first side portion, the third side portion has a bending part located at one end of the third side portion, which is disposed adjacent to and connecting to the opposite end of the second side portion, the third side portion has a second slot located adjacent to the bending part of the third side portion, and the second slot is disposed opposite to the first slot.

14. The frame structure of claim 13, further comprising a second mounting plate disposed corresponding to the second slot and located in the main body, wherein the second mounting plate has at least a fixing portion;

wherein the second mounting plate is movable to be received in the main body or to be moved through the second slot to expose from the main body by rotating or sliding.

15. The frame structure of claim 14, wherein one end of the second mounting plate is pivotally connected to the inner wall of the second side portion to form a second pivoting part, the second mounting plate is rotatable about the second pivoting part, and the second mounting plate is capable of passing through the second slot by rotating.

16. The frame structure of claim 14, further comprising two sliding tracks disposed on the inner wall of the second side portion, wherein the first mounting plate and the second mounting plate are connected to and limited to the sliding tracks, and the first mounting plate and the second mounting plate are capable of passing through the first slot and the second slot, respectively, by sliding.

17. The frame structure of claim 14, wherein each of the first mounting plate and the second mounting plate has at least a fixing portion, which is a hole structure, and the fixing portions of the first mounting plate and the second mounting plate are fixed by nailing, screwing, or riveting so as to install the frame structure on the external structure.

18. The frame structure of claim 14, wherein the inner wall of the second side portion has first connecting structures, the first mounting plate and the second mounting plate are configured with second connecting structures, the second connecting structures are disposed corresponding to the first connecting structures, and the first mounting plate and the second mounting plate are fixed to the first connecting structures of the main body via the second connecting structures; and one of the first connecting structures and the second connecting structures is a convex structure, a concave structure, or an opening structure.

19. The frame structure of claim 14, further comprising:

at least an elastic plate having a first end and a second end, wherein the first end is connected to the inner wall of the second side portion, and the second end is contacted against and fixed to the first mounting plate or the second mounting plate;

wherein the first mounting plate or the second mounting plate has a plurality of positioning parts corresponding to the second end of the elastic plate, and the second end of the elastic plate is fixed to the corresponding positioning part; and wherein the elastic plate has at least a bended tail, and the second end of the elastic plate is released from the positioning part by pressing the bended tail.

* * * * *